US008505450B2

(12) United States Patent
Bangel et al.

(10) Patent No.: US 8,505,450 B2
(45) Date of Patent: Aug. 13, 2013

(54) PRINTING UNIT, PRINTING PRESS AND METHOD OF PRODUCING LABELS OR SELF-ADHESIVE LABELS IN A PRINTING PRESS

(75) Inventors: Dieter Bangel, Hüttenberg (DE); Thomas Demand, Wetzlar (DE)

(73) Assignee: Gallus Druckmaschinen GmbH, Langgoens-Oberkleen (DE)

( * ) Notice: Subject to any disclaimer, the term of this patent is extended or adjusted under 35 U.S.C. 154(b) by 905 days.

(21) Appl. No.: 12/237,796

(22) Filed: Sep. 25, 2008

(65) Prior Publication Data

US 2009/0078135 A1 Mar. 26, 2009

(30) Foreign Application Priority Data

Sep. 25, 2007 (DE) ..... 10 2007 045 876

(51) Int. Cl.
*B41F 13/24* (2006.01)

(52) U.S. Cl.
USPC ..... 101/247; 101/139; 101/145; 101/182; 101/248

(58) Field of Classification Search
USPC ..... 101/247
See application file for complete search history.

(56) References Cited

U.S. PATENT DOCUMENTS

| | | | | |
|---|---|---|---|---|
| 1,901,075 | A * | 3/1933 | Bechman | 101/247 |
| 2,751,843 | A * | 6/1956 | Faeber | 101/352.08 |
| 3,098,434 | A * | 7/1963 | Lime | 101/178 |
| 3,443,516 | A | 5/1969 | Schnall | |
| 3,448,686 | A * | 6/1969 | Bohman | 101/352.08 |
| 3,935,815 | A * | 2/1976 | Keijser | 101/247 |
| 4,397,237 | A * | 8/1983 | Makosch | 101/247 |

(Continued)

FOREIGN PATENT DOCUMENTS

| | | |
|---|---|---|
| DE | 1265759 | 4/1968 |
| DE | 3825517 C2 | 2/1990 |

(Continued)

OTHER PUBLICATIONS

German Search Report dated Sep. 18, 2008.

(Continued)

*Primary Examiner* — Jill Culler
(74) *Attorney, Agent, or Firm* — Laurence A. Greenberg; Werner H. Stemer; Ralph E. Locher

(57) ABSTRACT

A compact printing unit includes a plate cylinder, an impression cylinder, and an ink applicator roller in a printing press, in particular a label printing press. In the printing unit, the plate cylinder is disengageable from cylinders contacting the plate cylinder for the purpose of format variation. The plate cylinder is pivotable about the impression cylinder about a pivot axis which is parallel to the axis of rotation of the impression cylinder and a distance between the axes of rotation of the plate cylinder and the impression cylinder is variable. A printing press and a method of producing labels or self-adhesive labels in a printing press are also provided.

24 Claims, 10 Drawing Sheets

(56) References Cited

U.S. PATENT DOCUMENTS

| | | | | |
|---|---|---|---|---|
| 4,991,505 | A * | 2/1991 | D'Heureuse et al. | 101/248 |
| 5,142,977 | A | 9/1992 | Gertsch et al. | |
| 5,690,029 | A | 11/1997 | Herrmann et al. | |
| 5,697,297 | A * | 12/1997 | Rasmussen | 101/219 |
| 5,771,805 | A * | 6/1998 | Branas et al. | 101/248 |
| 6,457,407 | B2 * | 10/2002 | Leib et al. | 101/145 |
| 6,494,138 | B1 * | 12/2002 | Gottling et al. | 101/479 |
| 6,668,721 | B2 * | 12/2003 | Naka | 101/218 |
| 7,011,022 | B2 * | 3/2006 | Motard et al. | 101/217 |
| 2008/0295723 | A1 | 12/2008 | Kuhn | |

FOREIGN PATENT DOCUMENTS

| | | | |
|---|---|---|---|
| DE | 4435986 | C2 | 4/1996 |
| EP | 0352483 | A2 | 1/1990 |
| EP | 2006099 | A2 | 12/2008 |
| WO | 9836909 | A1 | 8/1998 |

OTHER PUBLICATIONS

European Search Report dated Jun. 21, 2011.

* cited by examiner

PRINTING UNIT, PRINTING PRESS AND METHOD OF PRODUCING LABELS OR SELF-ADHESIVE LABELS IN A PRINTING PRESS

CROSS-REFERENCE TO RELATED APPLICATION

This application claims the priority, under 35 U.S.C. §119, of German Patent Application DE 10 2007 045 876.4, filed Sep. 25, 2007; the prior application is herewith incorporated by reference in its entirety.

BACKGROUND OF THE INVENTION

Field of the Invention

The invention relates to a printing unit including a plate cylinder, an impression cylinder and an ink applicator roller. In the printing unit, a plate which is received on the plate cylinder is capable of being brought into contact and engaged with the ink applicator roller. The plate cylinder and the impression cylinder form a printing nip for printing on a substrate. Moreover, the invention relates to a printing press including such a printing unit and a method of producing labels or self-adhesive labels in a printing press.

Printing machines or printing presses which are constructed or used for printing labels or packaging face increasingly high requirements in terms of efficiency and ease of operation. At the same time, they need to offer maximum variability in the range of products they produce. One aspect is to produce as little waste as possible, for example when the printing press is changed from one print job to another, even from one printing process to another or from one printing length to another. Common in-line narrow-web printing presses constructed for label printing, in particular for printing self-adhesive labels, frequently have a configuration wherein printing material or substrates are guided by a plurality of cylinders and rollers between different process levels (for example for printing and drying). That means that a web section of considerable length is stored in the printing press. Consequently, a lot of waste may be produced. A label printing press which can be switched between different printing processes is described in International Publication No. WO 2005/028202 A1, corresponding to U.S. Patent Application Publication No. US 2006/0156934 A1. A new machine construction, which ensures that a comparatively short web section is stored in the printing press, requires first and foremost a printing unit configuration which, on one hand, provides the desired variability in terms of printing processes and printing lengths and, on the other hand, a short web path.

Cylinders are frequently supported so as to pivot for the purpose of engaging and disengaging individual cylinders. German Published, Non-Prosecuted Patent Application DE 44 35 986 A1 discloses an offset printing unit including a corresponding apparatus for engaging and disengaging a blanket cylinder. An optimum pressure can be set and printing material of different thickness can be accommodated by displacing pivot arms. An offset printing unit of variable printing length is described, for example, in European Patent Application EP 1101 611 A1, corresponding to U.S. Pat. No. 6,694,877. Spindle drives pivot support arms about an axis in order to move the axes of rotation of the plate cylinder, the blanket cylinder, and the impression cylinder away from and towards each other. Printing cylinders and blanket cylinders of different format can be installed into the printing unit.

British Patent 1,147,778, corresponding to U.S. Pat. No. 3,443,516 A1, describes an embodiment of an offset printing unit in a sheet-fed printing press wherein the blanket cylinder is pivotable about the axis of rotation of the plate cylinder through the use of a support arm, for engagement and disengagement purposes. The blanket cylinder can simultaneously be disengaged from the plate cylinder in a superimposed radial movement.

SUMMARY OF THE INVENTION

It is accordingly an object of the invention to provide a printing unit of compact construction, a printing press and a method of producing labels or self-adhesive labels in a printing press, which overcome the hereinafore-mentioned disadvantages of the heretofore-known devices and methods of this general type and in which a plate cylinder is disengageable from cylinders contacting the plate cylinder for the purpose of format variation.

With the foregoing and other objects in view there is provided, in accordance with the invention, a printing unit, comprising a plate cylinder, which may also be referred to as a master cylinder, an impression cylinder, and an ink applicator roller. In the printing unit of the invention, a plate received on the plate cylinder is engageable so as to be brought into contact with the ink applicator roller while the plate cylinder and impression cylinder form a nip to print on a substrate. The plate cylinder is pivotable about a pivot axis which is parallel to the axis of rotation of the impression cylinder, and a distance between the axes of rotation of the plate cylinder and the impression cylinder is variable.

In accordance with another feature of the invention, the pivot axis may, in particular, be within the contour of the impression cylinder. In addition or as an alternative, when the plate cylinder is pivoted about the pivot axis, the impression cylinder may at least partly be located in a circle segment limited by a line defined by the movement of the axis of rotation of the plate cylinder. In other words, the plate cylinder is pivotable about the impression cylinder, and not away from the impression cylinder. The pivot axis may be located within the plate cylinder or behind the plate cylinder, as viewed from the axis of rotation of the plate cylinder. The distance between the axes of rotation may be varied along a linear or straight path. Depending on the actual embodiment of the printing unit of the invention, the impression cylinder and/or the ink applicator roller may be received with an axis of rotation which is supported to be fixed to the frame and stationary or displaceable.

In particular, an element receiving the plate cylinder is pivotable, with the distance between the receiving location of the plate cylinder and the pivot axis being variable. A combination of the two degrees of freedom of movement or adjustment options provides the possibility of carrying out format adjustments and of effecting impression throw-on and throw-off as well as engagement between the plate cylinder and the ink applicator roller to supply ink to the plate cylinder. The printing unit of the invention does not require much installation space and is cost-efficient because it is formed of only a few components.

In accordance with a further feature of the invention, which is particularly advantageous for label printing, the printing unit may be constructed to implement a flexographic printing process or a letterpress printing process or a gravure process.

In accordance with an added feature of the invention, the pivot axis of the plate cylinder preferably extends along the central axis of the impression cylinder or coincides with the central axis of the impression cylinder. As another preferred feature, the position in space of the axis of rotation of the plate cylinder is displaceable. The position in space of the axis of rotation of the impression cylinder may be stationary. The position in space of the axis of rotation of the ink applicator roller and of potential further components of an inking unit of the printing unit of the invention may be displaceable.

In accordance with an additional feature of the invention, the printing unit of the invention may include a mechanical adjustment system or an adjustment actuation system for carrying out the pivoting movement and the distance variation of the impression cylinder in a coupled way. In this manner, simplified operation of the adjustment is achieved at a high degree of automation, thus increasing cost-effectiveness.

In accordance with yet another feature of the invention, in the printing unit of the invention, the plate cylinder may be received in the printing unit so as to be removable. Plate cylinders of different diameter may be receivable in the printing unit. As an alternative, intermediate sleeves of different diameters may be receivable on the plate cylinder.

In accordance with yet a further preferred feature of the invention, when the impression cylinder and the plate cylinder are engaged with each other in the printing position, the axes of rotation of the plate cylinder and of the impression cylinder in the printing unit of the invention are located in a vertical plane in such a way that the printing nip is located in the upper tangential point of the impression cylinder (which is preferred) or of the plate cylinder. The impression cylinder may form the center of the printing unit.

In accordance with yet an added feature of the invention, the printing unit includes a dryer device acting on a substrate which is located on the impression cylinder. In accordance with concrete embodiments, the dryer device may, for example, be a UV dryer unit, an infrared dryer unit, or a hot-air dryer unit. As an advantageous consequence, process levels of a printing press which is equipped with the printing unit of the invention may be combined to achieve a short web path through the printing press.

In accordance with yet an additional feature of the invention, the printing unit may be constructed in such a way as to be operated in a first direction of rotation of the impression cylinder to print on a front side of the printing substrate and in a second direction of rotation counter to the first direction of rotation to print on a back side of the printing substrate.

In accordance with again another feature of the invention, the impression cylinder and/or the plate cylinder of the printing unit of the invention may be drivable by a separate drive.

With the objects of the invention in view, there is also provided a printing press, in particular a label printing press. In accordance with the invention, the printing press is distinguished by at least one printing unit in accordance with the invention having features or combinations of features as set forth herein. The printing press is preferably of in-line construction and/or of modular construction with respect to individual subassemblies, in particular the printing units or printing unit groups, including their support structures.

In accordance with another feature of the invention, the substrate may be web-shaped. In particular, the web may be a multi-layer web of material, in particular a material for self-adhesive labels on a carrier web. The printing press may be a web-fed printing press. It may include a transport device for moving the web-shaped substrate through the printing press. The printing press may be a so-called narrow-web printing press. The width of the web to be printed may be less than 900 mm, in particular less than 515 mm. Typical widths of embodiments of narrow-web printing presses in accordance with the invention are in particular 330 mm and 280 mm.

The printing press of the invention may include a plurality of printing units, in particular four printing units for multicolor printing. The printing press may include a plurality of printing units constructed in accordance with the invention. Short web paths through the press are possible due to the advantageous configuration of the cylinders of the printing unit of the invention. Consequently, the amount of waste can advantageously be reduced. Faster make-ready and register adjustments become possible.

In accordance with a further feature of the invention, embodiments of the printing press of the invention which are particularly suited for label printing may include a straight path of the web-shaped substrate through a plurality of printing units of the invention. The straight path of the web-shaped substrate may be horizontal.

In accordance with an added feature of the invention, a printing press according to the invention may in addition include individual ones or combinations of the following features: a printing unit of the invention may be received on a frame wall with one or more integrated drives. The printing press may include receiving elements for alternately receiving modules which are connectible and removable to carry out different printing processes or to treat/finish the substrate. Printing processes may include, in particular, flexographic printing, gravure, letterpress printing, offset printing, direct or indirect planographic printing, foil stamping, screen printing, inkjet printing, or xerographic printing. Types of treatment or processing in particular include punching, cutting, diecutting, perforating, creasing, folding, or varnishing. In other words, the printing press may include a (standardized or neutral) interface for receiving printing unit or processing unit components which are connectible to the printing press. In particular, components which may be used by all of these units or which may complete these units to make them functional may directly be parts of the printing press. The order of the individual printing units and/or processing units may be selected and adapted in accordance with the print job.

In accordance with an additional feature of the invention, the printing unit of the invention may be received by a bearing element in a support element which is at least partially made of rock, in particular natural rock or a compound including natural rock. A printing press including a support element which is at least partly made of rock is described in German Published, Non-Prosecuted Patent Application DE 10 2006 042 884 A1 and in co-pending U.S. Patent Application Publication No. US 2008/0063458 A1, claiming the priority of the German Patent Application. Both applications and the entire content of their disclosure are explicitly included by reference herein.

With the objects of the invention in view, there is concomitantly provided a method of producing labels or self-adhesive labels in a printing press. In accordance with the invention, a printing press having features or combinations of features as set forth herein is operated to process a web-shaped substrate which is suited for producing labels or self-adhesive labels. In accordance with a preferred embodiment, a web-fed printing press is operated in which the path of the web-shaped substrate runs straight, in particular horizontally, through a plurality of printing units. In the process, individual color separations of a multicolor print are printed into each other in a wet-on-wet process. A drying process after completion of the multicolor print is optional.

Other features which are considered as characteristic for the invention are set forth in the appended claims.

Although the invention is illustrated and described herein as embodied in a printing unit, a printing press and a method of producing labels or self-adhesive labels in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
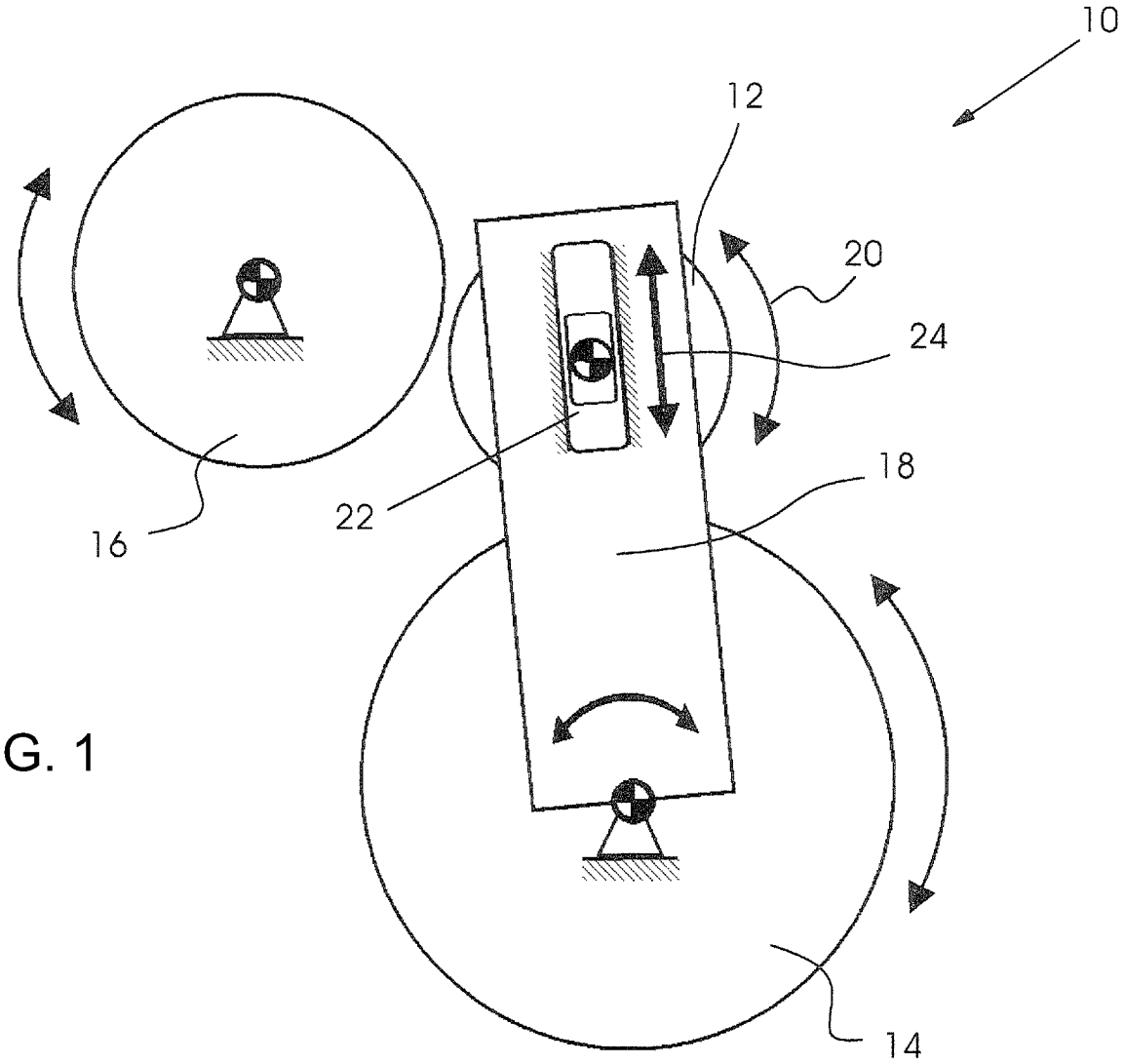
FIG. 1 is a diagrammatic, side-elevational view of a preferred embodiment of the printing unit in accordance with the invention, illustrating degrees of freedom of movement.

Referring now to the figures of the drawings in detail and first, particularly, to FIG. 1 thereof, there is seen an embodiment of a printing unit 10 in accordance with the invention for flexographic printing. The printing unit 10 includes a master cylinder or plate cylinder 12, an impression cylinder 14 and an ink applicator roller 16, which, to be more precise, is a screen roller. The cylinders are rotatable about their respective axes of symmetry. The impression cylinder 14 and the ink applicator roller 16 are fixed to a frame of the printing press. The impression cylinder 14 is disposed at the center of the printing unit 10. A rocker 18 or support arm, in particular just or precisely one rocker 18, is used to pivot the plate cylinder 12 about the axis of rotation of the impression cylinder 14 in a pivoting movement 20. The rocker 18 is supported in the axis of rotation of the impression cylinder 14. The rocker 18 can operate on the drive side of the plate cylinder 12 so that an operator can access the plate cylinder on the operator side for the purpose of changing format. The rocker 18 has a linear guide 22 so that a linear distance variation 24 between the plate cylinder 12 and the impression cylinder 14 is carried out by a displacement of a position in space of the axis of rotation of the plate cylinder 12 (without tilting the axis). This embodiment represents a simple printing unit construction providing simple and accurate printing cylinder adjustment.

In accordance with a non-illustrated refinement, the impression cylinder 14 has an integrated cooling system. In addition, due to its configuration, it may be accessible in at least three positions for drying a printed substrate on the impression cylinder 14 (also see the description below with reference to FIGS. 7A, 7B, 9A and 9B).

In order to provide for a practical implementation of the pivoting movement, one of the actuators listed below may be used to move the rocker: a threaded drive with manual adjustment or a threaded drive with motor adjustment, a pneumatic cylinder, a hydraulic cylinder, a gearwheel with a pinion with manual adjustment or a gearwheel with a pinion with motor adjustment, a worm and a worm gear with manual adjustment or a worm with a worm gear with motor adjustment; a toothed belt with manual adjustment or a toothed belt with motor adjustment, or a thrust crank rocker with manual adjustment/motor adjustment with a threaded spindle, in pneumatic or hydraulic cylinder adjustment as well as in manual adjustment with a rack and a gearwheel manually or by motor.

In order to provide for a practical implementation of the distance variation, in particular in a linear movement, one of the actuators listed below may be used to move the linear pushing element: a spindle-type lifting gear with manual adjustment, a spindle-type lifting gear with motor adjustment, a threaded spindle with manual adjustment, a threaded spindle with motor adjustment, a rack and a gearwheel with manual adjustment, a rack and a gearwheel with motor adjustment, a pneumatic cylinder, a hydraulic cylinder, or a push crank rocker with manual adjustment/motor adjustment with a threaded spindle, in pneumatic or hydraulic cylinder adjustment as well as in manual adjustment with a rack and a gearwheel manually or by motor.

The actuators listed above may be embodied as a combination of manual and automatic actuating elements. In other words, the adjustment may be made manually, partly automatically, or fully automatically.

Figure 2:
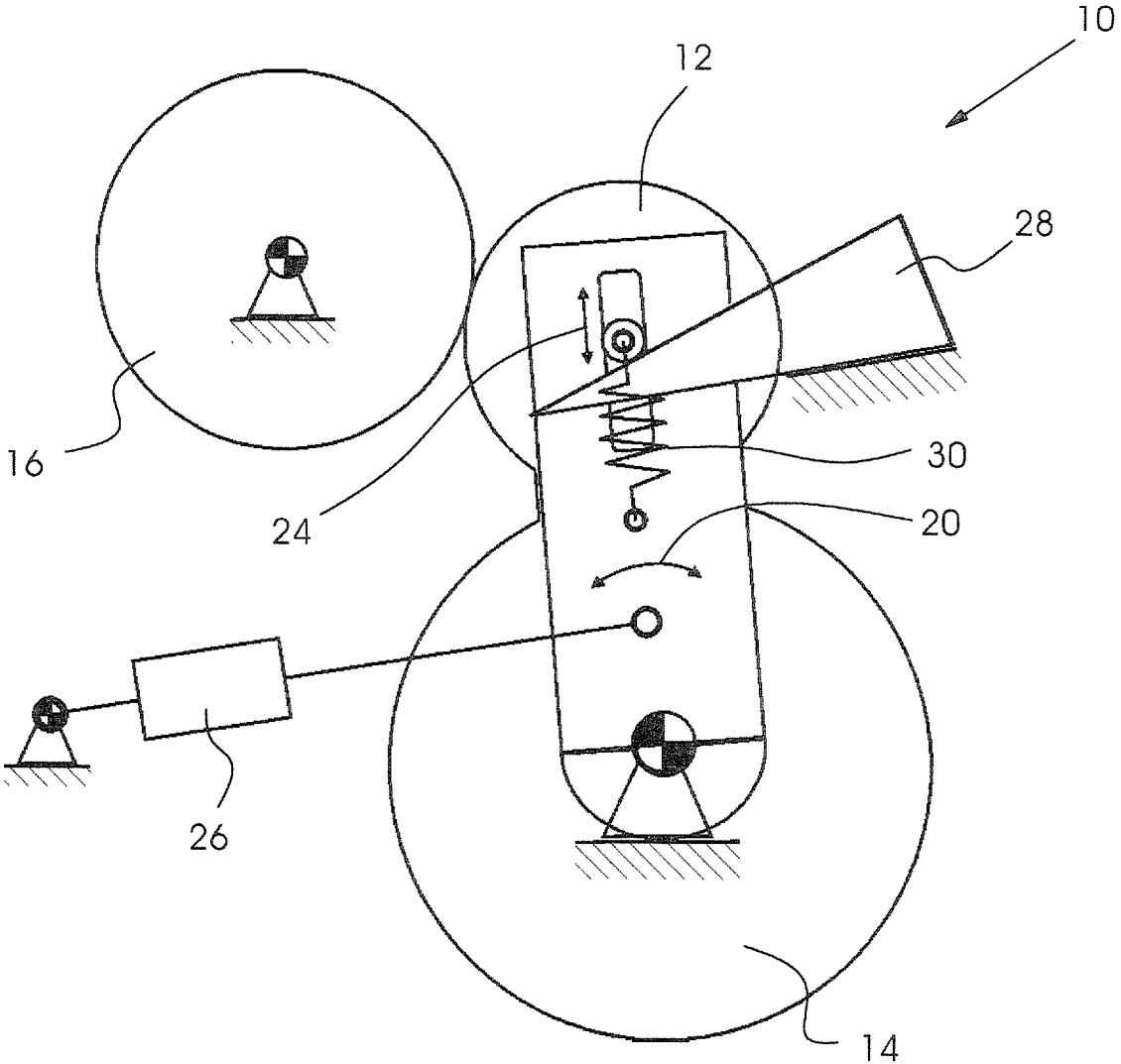
FIG. 2 is a side-elevational view of a first embodiment of the printing unit in accordance with the invention with coupled degrees of freedom.

FIG. 2 illustrates a first embodiment of the printing unit 10 in accordance with the invention. The printing unit 10 has coupled degrees of freedom for the pivoting movement 20 and the linear distance variation 24. In order to disengage the plate cylinder 12 from the ink applicator roller 16 and at the same time to increase the distance of the axis of rotation relative to the impression cylinder 14, the rocker 18 is moved through the use of an actuating element 26 which may, for example, be an actuator from among the list given above. The axis of the plate cylinder 12 is guided in a connecting link or coulisse 28 and is subjected to the force of a restoring element 30, for example a tension spring, having a force component directed towards the coulisse 28.

Figure 3:
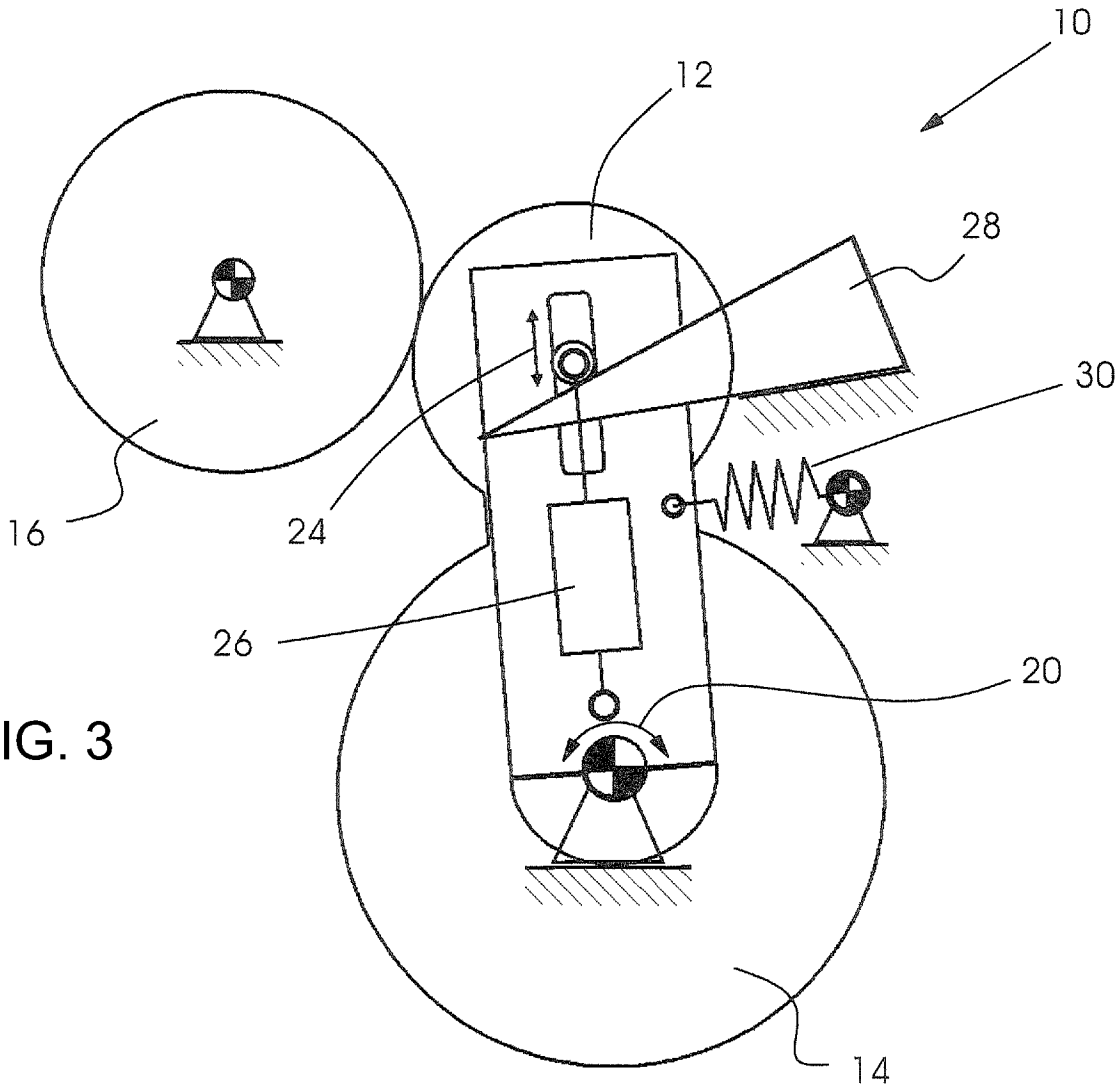
FIG. 3 is a side-elevational view of a second embodiment of the printing unit in accordance with the invention with coupled degrees of freedom.

FIG. 3 diagrammatically illustrates a second embodiment of the printing unit 10 in accordance with the invention with coupled degrees of freedom for the pivoting movement 20 and the linear distance variation 24. In order to modify the absolute position of the plate cylinder 12 relative to the impression cylinder 14 and to the ink applicator roller 16, a connecting link slider with an actuator 26, which may be one of the actuators listed above, is provided. The axis of the plate cylinder 12 is subjected to the force of a restoring element 30, for example a tension spring, having a force component directed towards the connecting link or coulisse 28.

Figure 4:
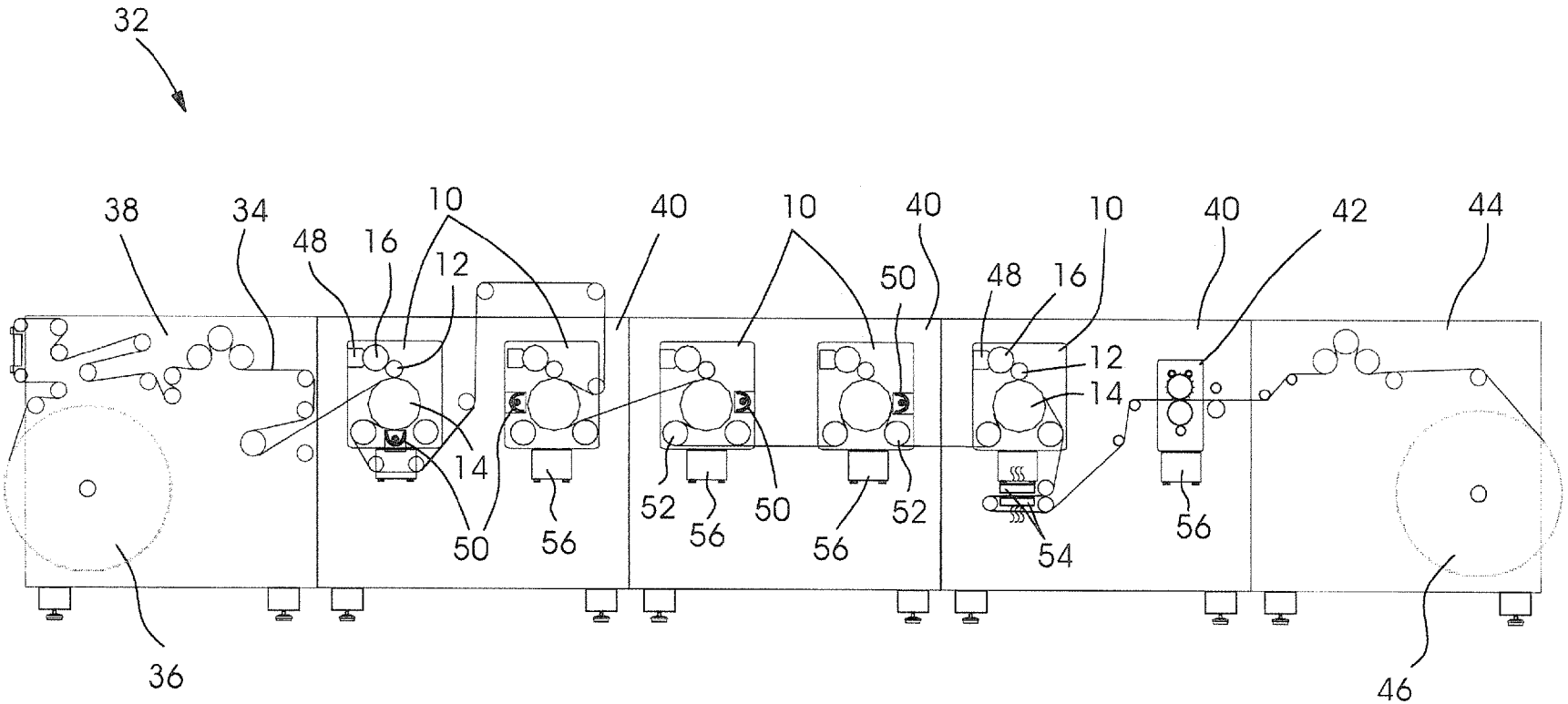
FIG. 4 is a longitudinal-sectional view of a preferred embodiment of a printing press according to the invention.

FIG. 4 illustrates a view of a preferred embodiment of a printing press 32 in accordance with the invention, in this case a label printing press in accordance with the invention, of in-line construction with printing units 10 in accordance with the invention following each other in the horizontal direction. The label printing press processes a web-shaped substrate 34. The substrate is unwound from a reel of substrate 36 in a feeding section 38 of the printing press 32 and is fed through the printing press 32 along a path. The printing press 32 has a plurality of frame modules 40, namely three frame modules 40 in the given example. In this embodiment, each frame module 40 receives two printing units 10 or one printing unit 10 and one processing unit 42, in this case a diecutting unit for cutting the labels out of the web-shaped substrate 34. The individual processing stations are followed by a delivery section 44 in which the finished products are wound onto a label reel 46. The feeding section 38, the frame modules 40 and the delivery section 44 are connected in such a way that they can be removed or separated from each other. That is to say, the printing press 32 is of modular construction.

The representation of the individual printing units 10 in FIG. 4, in this case flexographic printing units, includes chambered doctor blades 48 in addition to the plate cylinders 12, impression cylinders 14 and ink applicator rollers 16. Furthermore, the printing units 10 in the printing press 32 have various drying devices: UV drying devices 50 are associated with the impression cylinders 14 downstream at the respective printing nip of the printing unit 10 to be able to dry the printed substrate 34 directly on the impression cylinder 14. The printing units 10 also include web-guiding rollers 52 for guiding the web-shaped substrate 34. The fifth printing unit 10 includes a hot-air drying device 54 for both the upper side and the lower side of the substrate 34. The hot-air drying device 54 is provided downstream of the fifth printing unit 10. The web-shaped substrate is guided through the hot-air drying device 54. The individual printing units 10 and the processing unit 42 are fixed to the frame modules 40 of the printing press 32 by a receiving element 56. By way of example, the second printing unit 10 is operated to print on the back side of the substrate.

Figure 5:
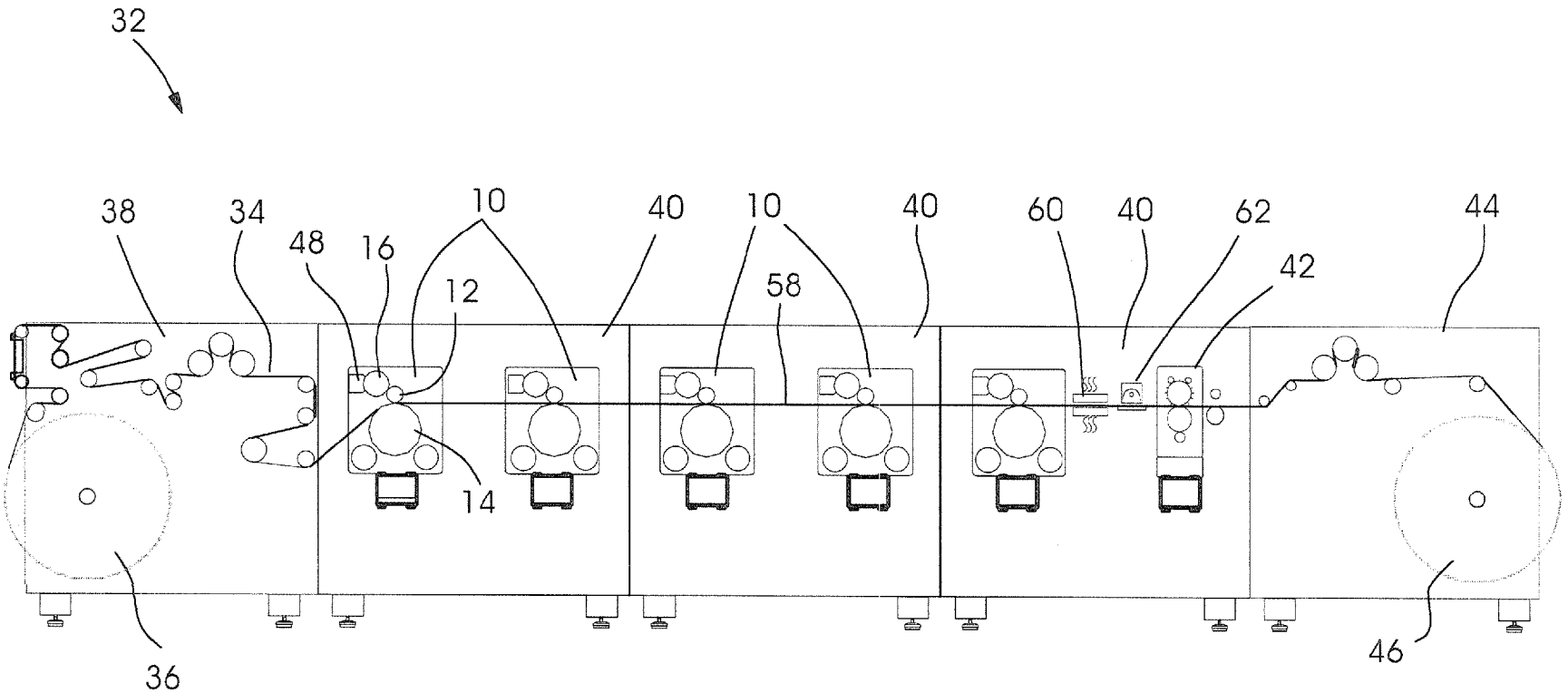
FIG. 5 is a longitudinal-sectional view of the printing press shown in FIG. 4 in an operating configuration including a straight and horizontal web path.

FIG. 5 illustrates a printing press in a machine construction corresponding to FIG. 4 with an operative configuration having a straight and horizontal web path to carry out a wet-on-wet multicolor printing operation. Starting from the reel of substrate 36 in the feeding section 38, the web-shaped substrate 34 is moved through the printing units 10 received on the frame modules 40 on a straight and horizontal path 58 of web travel. A hot-air drying device 60 and a UV drying device 62 are provided upstream of the processing unit 42 and downstream of the fifth printing unit 10. Depending on the drying process which is suitable for the printing inks that have been used in the press, the printed substrate 34 may be dried by hot air (to expel solvents) or UV light (for hardening). The finished labels are stored on a label reel 46 in the delivery section 44.

In each one of the printing units 10, the respective printing nip, which is formed by the plate cylinder 12 and the impression cylinders 14 and through which the web-shaped substrate 34 is passed, is located at an upper tangential point of the impression cylinder 14. Although not explicitly illustrated in FIG. 5, to provide format variability, the position of the ink applicator roller 16 and other inking unit components, in particular of the chambered doctor blade 48, can be adjusted to be able to accommodate different printing lengths, for example by receiving plate cylinders 12 of different diameters. The plate cylinder 12 is always in contact or engaged with the impression cylinder 14 at the upper tangential point of the impression cylinder 14.

Figure 6B:
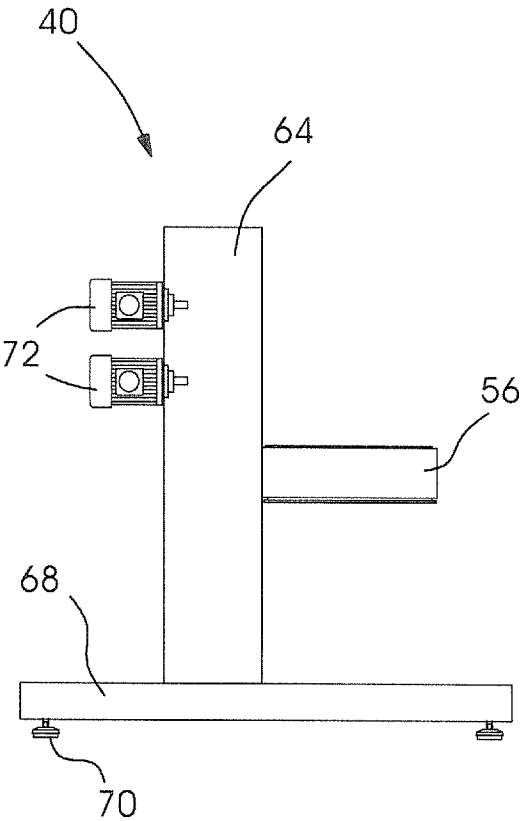
FIG. 6A is a front-elevational view and FIGS. 6B-6D are side-elevational views of an embodiment of a frame module for two printing units.
Figure 6A:
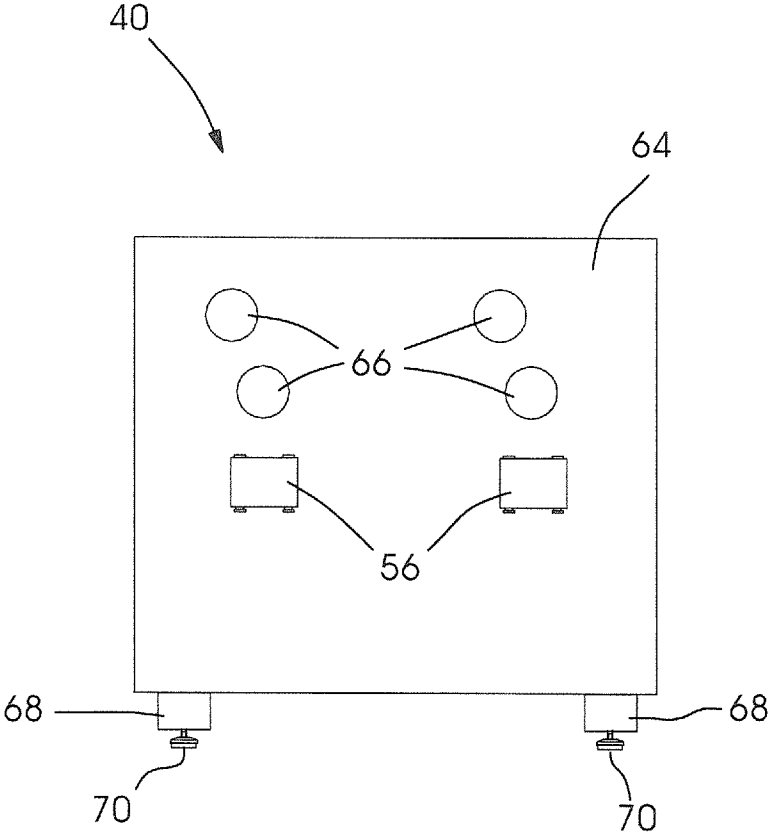
Figure 6D:
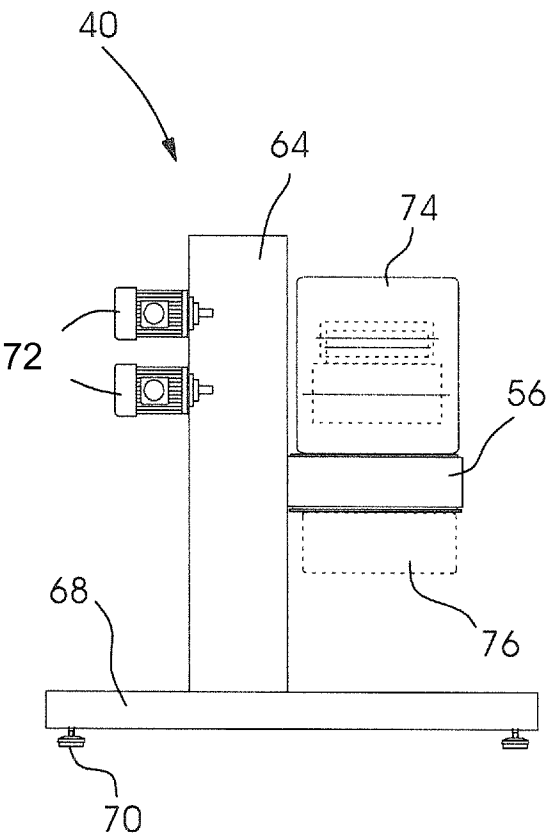
Figure 6C:
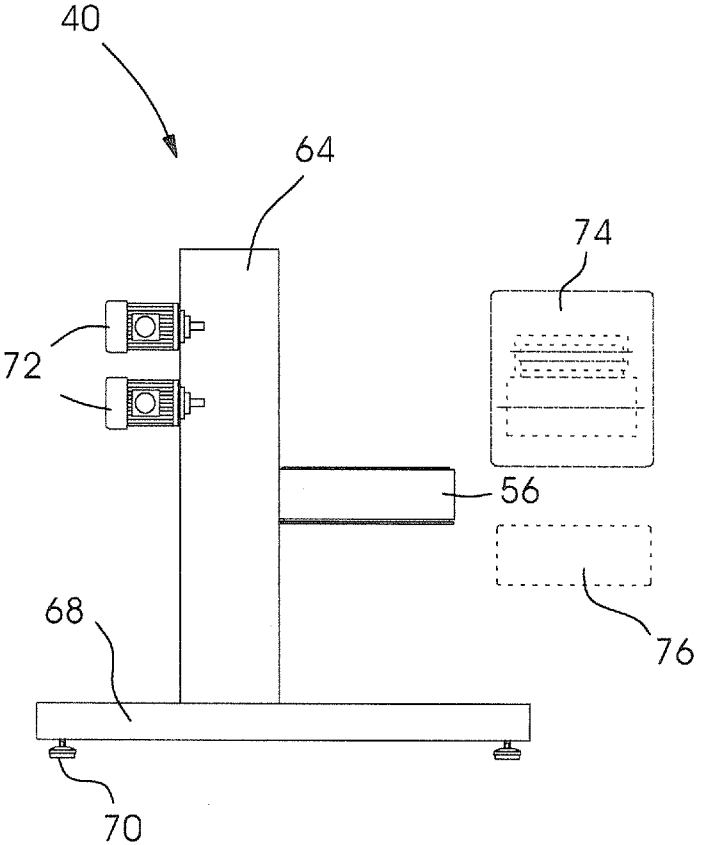

FIGS. 6A to 6D refer to an embodiment of a frame module 40 for two printing units 10 in accordance with the invention. FIG. 6A is a view of the frame module 40. The frame module 40 includes a support element in the form of a side wall 64 made of rock, to be precise a single piece of natural rock, in particular granite, or a monolith. There are four driving interfaces 66 for the printing unit modules to be received. A mechanical interface is formed by a respective receiving element 56. The side wall 64 made of rock rests on two base foot profiles 68. The frame module 40 can be aligned through the use of leveling elements 70. FIGS. 6B to 6D are side views of the frame module 40. Separate integrated drives in the form of motors 72 are attached to the back of the side wall 64 made of rock and are accessible through the drive interfaces 66. A process module 74, which includes printing unit or processing unit components, can be received on a receiving element 56 so as to be connectible and removable. An additional component module 76, which for example includes a hot-air drying device, may be received underneath the receiving element 56 on the frame module 40 so as to be connectible and removable. For this purpose, the receiving element 56 may include, for example, linear guides or rails for the process module 74 and/or the additional component module 76 to be slid on.

Figure 7B:
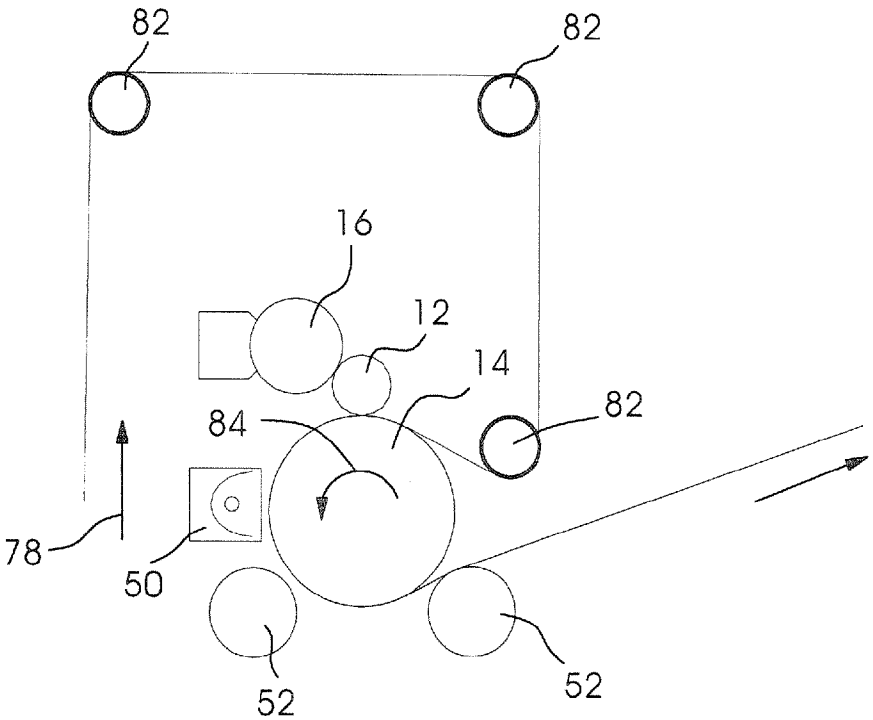
FIGS. 7A and 7B are side-elevational views illustrating a web path through an embodiment of the printing unit in accordance with the invention for front-side printing and back-side printing and simultaneous UV drying.
Figure 7A:
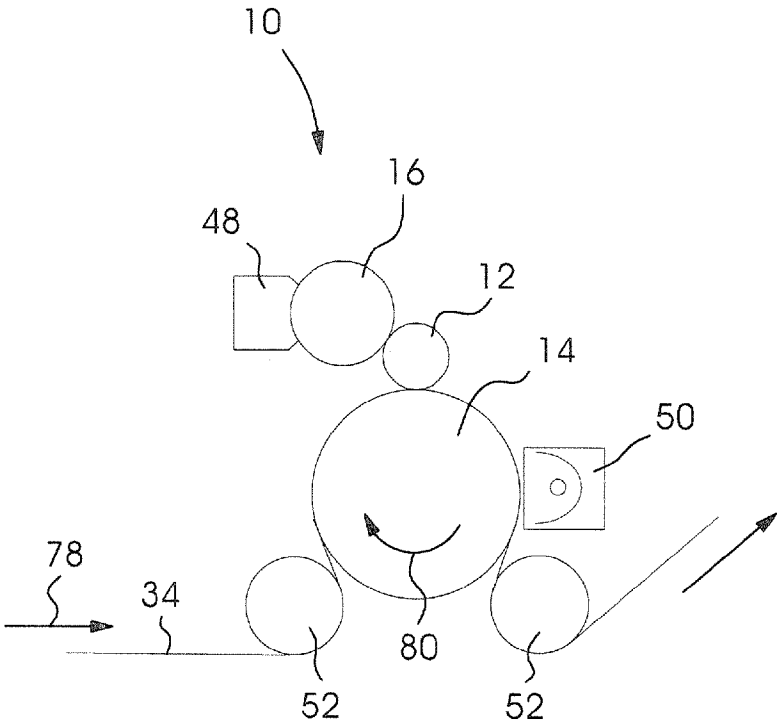

FIGS. 7A and 7B are used to explain the path of web travel of the substrate 34 for front-side printing and back-side printing with simultaneous UV drying in an embodiment of the printing unit 10 of the invention. The substrate 34 is guided through the printing unit 10 in a direction of substrate transport 78. In FIG. 7A, the impression cylinder 14 is operated to rotate in a first direction of rotation 80 for front-side printing. The web-shaped substrate 34, which is guided by the web-guiding rollers 52, partly wraps around the impression cylinder 14. The impression cylinder 14 and the plate cylinder 12 form a printing nip at the upper tangential point. A printing form received on the plate cylinder 12 is supplied with ink by the ink applicator roller 16, which in turn receives ink from the chambered doctor blade 48. Downstream of the printing nip as viewed in the direction of transport 78 of the substrate (right-hand exiting side) there is a UV drying device 50 for drying the substrate 34 as it is still located on the impression cylinder 14. As is shown in FIG. 7B, for back-side printing, the guide rollers 82 guide the substrate across the printing unit 10 in such a way that the substrate reaches the printing nip formed between the plate cylinder 12 and the impression cylinder 14 from the opposite direction as compared to FIG. 7A. The impression cylinder 14 rotates in a second direction of rotation 84. As compared to the situation illustrated in FIG. 7A, a UV drying device 50 is located at a different position downstream of the printing nip as viewed in the direction of transport 78 of the substrate (left-hand exiting side). The UV drying device 50 dries the substrate 34 while it is still located on the impression cylinder 14.

Figure 8B:
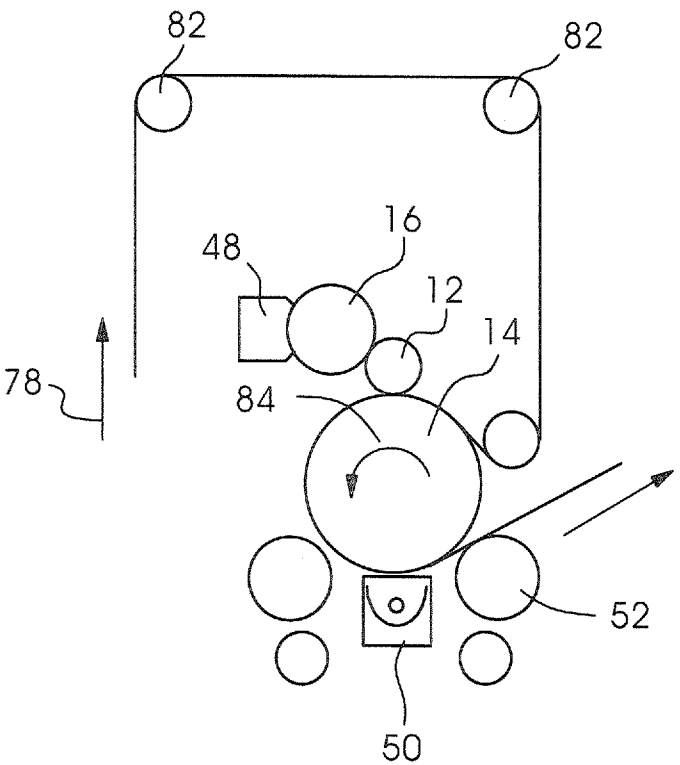
FIGS. 8A and 8B are side-elevational views illustrating a web path through an embodiment of the printing unit in accordance with the invention for front-side printing and back-side printing and simultaneous UV drying in an alternative configuration different from that of FIGS. 7A and 7B.
Figure 8A:
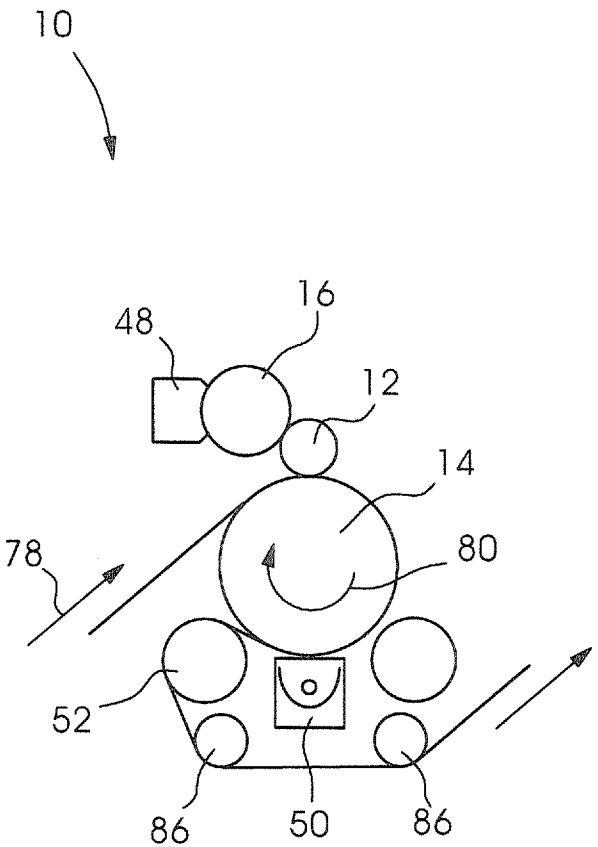

FIGS. 8A and 8B illustrate an alternative configuration of the path of web travel through an embodiment of the printing unit 10 in accordance with the invention for front-side printing and back-side printing with simultaneous UV drying. Both the configuration for front-side printing shown in FIG. 8A and the configuration for back-side printing shown in FIG. 8B correspond to FIGS. 7A and 7B. The same reference numerals are used and reference may be made to the description of FIGS. 7A and 7B. FIGS. 8A and 8B illustrate an embodiment in which a UV drying device 50 is directed to the lower tangential point of the impression cylinder 14. In this embodiment, the printing unit 10 can advantageously be operated with one and the same UV drying device 50 for both front-side printing as shown in FIG. 8A (with a first direction of rotation 80) and back-side printing as shown in FIG. 8B (with a second direction of rotation 84). For this purpose, in both modes of operation, the web-shaped substrate 34 wraps around the impression cylinder 14 far enough for the substrate 34 to be dried directly on the impression cylinder 14 in the lower tangential point. For front-side printing, further web-guiding rollers 86 are provided in addition to one of the two web-guiding rollers 52, whereas for back-side printing, the web-shaped substrate is guided by the other one of the two web-guiding rollers of the printing unit 10.

Figure 9B:
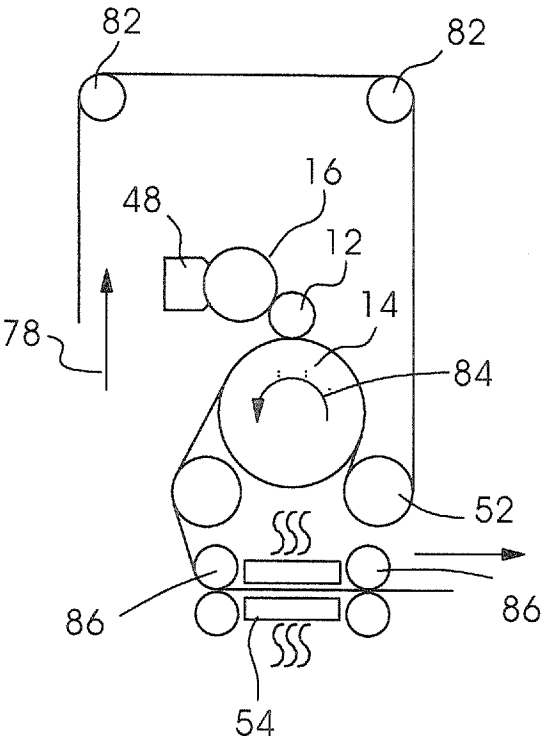
FIGS. 9A and 9B are side-elevational views illustrating a web path through an embodiment of the printing unit in accordance with the invention for front-side printing and back-side printing and simultaneous hot-air drying in an alternative configuration different from those of FIGS. 7A, 7B, 8A and 8B.
Figure 9A:
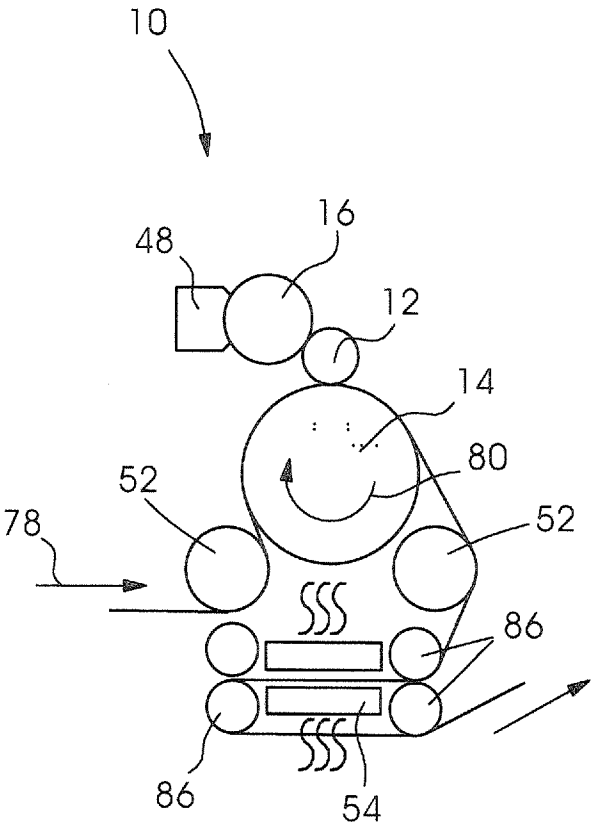

FIGS. 9A and 9B illustrate the path of web travel through an embodiment of the printing unit 10 in accordance with the invention for front-side printing and back-side printing with simultaneous UV drying in an alternative configuration which is different from that of FIGS. 7A, 7B, 8A and 8B. Both the configuration for front-side printing shown in FIG. 9A and the configuration for back-side printing shown in FIG. 9B correspond to FIGS. 7A and 7B. The same reference numerals are used and reference may be made to the description of FIGS. 7A and 7B. FIGS. 9A and 9B illustrate an embodiment in which a hot-air drying device 54 is provided below the impression cylinder 14. This drying device 54 can be used to dry both sides of the web-shaped substrate both in front-side printing (FIG. 9A) and in back-side printing (FIG. 9B). Further web-guiding rollers 86 are provided to guide the web-shaped substrate 34 through the hot-air drying device 54. The web-shaped substrate 34 is fed to the hot-air drying device 54 from the original entry side of the substrate 34 into the printing unit 10. In other words, the hot-air drying device 54 is operated in the same direction or orientation in both cases.

The invention claimed is:

1. A printing unit, comprising:

a plate cylinder for receiving a printing plate, said plate cylinder having an axis of rotation;

an impression cylinder having an axis of rotation and forming a printing nip with said plate cylinder for printing on a substrate; and an ink applicator roller to be engaged by the printing plate received on said plate cylinder for contacting said ink applicator roller;

said plate cylinder being pivotable about said impression cylinder about a pivot axis, said pivot axis being coaxial with said axis of rotation of said impression cylinder;

said plate cylinder being disengageable from said impression cylinder and said ink applicator roller for format variation;

said axes of rotation of said plate cylinder and said impression cylinder being spaced apart by a variable distance, the variable distance and a pivoting movement of said plate cylinder being coupled together for simultaneous movement; and a single actuating element for carrying out disengagement of said plate cylinder from said impression cylinder and disengagement of said plate cylinder from said ink applicator roller by controlling the simultaneous movement with said single actuating element.

2. The printing unit according to claim 1, wherein said impression cylinder is at least partly located in a circle segment limited by a line defined by a movement of said axis of rotation of said plate cylinder, when said plate cylinder pivots about said pivot axis.

3. The printing unit according to claim 1, wherein the printing unit is configured to carry out a flexographic printing process or a letterpress printing process or a gravure printing process.

4. The printing unit according to claim 1, wherein said axis of rotation of said plate cylinder occupies a movable position in space.

5. The printing unit according to claim 1, which further comprises at least one of a mechanical adjustment system or an adjustment actuation system for carrying out said pivoting movement and said distance variation of said plate cylinder in a coupled manner.

6. The printing unit according to claim 1, wherein said plate cylinder is removably connected in the printing unit, and the printing unit is configured to receive plate cylinders of different diameters.

7. The printing unit according to claim 1, wherein said plate cylinder is configured to receive intermediate sleeves of different diameters thereon.

8. The printing unit according to claim 1, wherein said axes of rotation of said plate cylinder and of said impression cylinder are in a vertical plane, forming said printing nip at an upper tangential point of said impression cylinder or of said plate cylinder, in a printing position.

9. The printing unit according to claim 1, which further comprises a dryer device acting on the substrate located on said impression cylinder.

10. The printing unit according to claim 1, wherein the printing unit is configured to operate in a first direction of rotation of said impression cylinder for front-side printing and in a second direction of rotation of said impression cylinder counter to said first direction of rotation for back-side printing.

11. The printing unit according to claim 1, which further comprises a separate drive for driving at least one of said impression cylinder or said plate cylinder.

12. A printing press, comprising at least one printing unit according to claim 1.

13. The printing press according to claim 12, wherein the substrate is web-shaped, and a transport device moves the web-shaped substrate through the printing press.

14. The printing press according to claim 13, wherein the web-shaped substrate follows a path running straight through a plurality of the printing units.

15. The printing press according to claim 14, wherein said straight path of the web-shaped substrate extends horizontally.

16. The printing press according to claim 12, wherein the printing press has at least one of an in-line construction or a modular construction.

17. The printing press according to claim 12, which further comprises a frame wall including at least one integrated drive, the printing unit being disposed on said frame wall.

18. The printing press according to claim 12, which further comprises receiving elements for alternately receiving and removably connecting modules for different printing processes or for treating the substrate.

19. The printing press according to claim 12, wherein the printing press is a label printing press.

20. The printing press according to claim 12, which further comprises a support element at least partly made of rock, and a bearing element disposed in said support element for receiving the printing unit.

21. A method of producing labels or self-adhesive labels in a printing press, the method comprising the following steps:

providing a printing press according to claim 12; and processing a web-shaped substrate suitable for producing labels or self-adhesive labels in the printing press.

22. The method of producing labels or self-adhesive labels in a printing press according to claim 21, which further comprises:

directing the web-shaped substrate along a path running straight through a plurality of the printing units; and printing individual color separations of a multicolor printing operation onto each other in a wet-on-wet process.

23. The method of producing labels or self-adhesive labels in a printing press according to claim 22, wherein the straight path of the web-shaped substrate extends horizontally.

24. A printing unit, comprising:

a plate cylinder for receiving a printing plate, said plate cylinder having an axis of rotation;

an impression cylinder having an axis of rotation and forming a printing nip with said plate cylinder for printing on a substrate; and an ink applicator roller to be engaged by the printing plate received on said plate cylinder for contacting said ink applicator roller;

said plate cylinder being pivotable about said impression cylinder about a pivot axis parallel to said axis of rotation of said impression cylinder;

said plate cylinder being disengageable from said impression cylinder and said ink applicator roller for format variation;

said axes of rotation of said plate cylinder and said impression cylinder being spaced apart by a variable distance, the variable distance and a pivoting movement of said plate cylinder being coupled together for simultaneous movement; and a single actuating element for carrying out disengagement of said plate cylinder from said impression cylinder and disengagement of said plate cylinder from said ink applicator roller by controlling the simultaneous movement with said single actuating element.

* * * * *